United States Patent [19]

Satoo

[11] 4,372,999

[45] Feb. 8, 1983

[54] STRINGER TAPE FOR SLIDE FASTENERS

[75] Inventor: Masaharu Satoo, Kurobe, Japan

[73] Assignee: Yoshida Kogyo K.K., Tokyo, Japan

[21] Appl. No.: 203,327

[22] Filed: Nov. 3, 1980

[30] Foreign Application Priority Data

Nov. 2, 1979 [JP] Japan ..... 54-152837[U]

[51] Int. Cl.[3] ..... A44B 19/34

[52] U.S. Cl. ..... 428/193; 24/205.16 R; 24/205.16 D; 428/196; 428/200; 428/226; 428/349

[58] Field of Search ..... 24/205.16 R, 205.16 D; 428/193, 196, 200, 226, 349

[56] References Cited

U.S. PATENT DOCUMENTS 3,866,275 2/1975 Amburg ..... 24/205.16 D

FOREIGN PATENT DOCUMENTS 2326782 12/1973 Fed. Rep. of Germany...24/205.16 D 29-633 1/1954 Japan .

727479 4/1955 United Kingdom ..... 24/205.16 R

*Primary Examiner*—James C. Cannon

*Attorney, Agent, or Firm*—Hill, Van Santen, Steadman, Chiara & Simpson

[57] ABSTRACT

A heat-sealable stringer tape, for slide fasteners, comprising: an elongate fabric woven of warp and weft threads and including a pair of longitudinally extending, spaced first and second marginal portions and an intermediate portion extending between the first and second marginal portions. The warp threads in the intermediate portion include a plurality of thermoplastic filament yarns which are disposed closely to one another at their interlacings with the weft threads. A higher degree of tension has been applied on the weft threads than on the warp threads of the intermediate portion while the fabric is been woven to make the thermoplastic warp yarns project beyond the weft threads.

2 Claims, 8 Drawing Figures

STRINGER TAPE FOR SLIDE FASTENERS

BACKGROUND OF THE INVENTION

1. Field of the Invention

The present invention relates generally to slide fasteners, and more particularly to a slide fastener stringer having a woven stringer tape heat-sealable to a garment of thermoplastic synthetic resin.

2. Prior Art

A known stringer tape for slide fasteners which is heat-sealable to a garment of thermoplastic synthetic resin includes an elongate woven fabric coated with a thermoplastic synthetic resin. However, this coated stringer tape is expensive because coating is time-consuming.

Japanese Utility Model Publication (Jikkosho) No. 29-633, published Jan. 27, 1954, discloses a heat-sealable slide fastener stringer which includes a woven stringer tape employing thermoplastic synthetic yarns as the warp threads while non-thermoplastic yarns are used as the weft threads. Although there is no concrete disclosure in the description, it is understood from the Japanese Publication and its drawing, as redrawn as FIG. 5 hereof, that the warp threads 14 are noticeably spaced from one another. Accordingly, the topmost and undermost surfaces 16,17 of this prior tape are not defined dominantly by the thermoplastic synthetic yarns 14 but the non-thermoplastic yarns 15 (FIG. 5). With this arrangement proper and firm attachment of the fastener stringer to a garment of thermoplastic synthetic resin is difficult to achieve.

SUMMARY OF THE INVENTION

An object of the present invention is to provide a heat-sealable stringer tape for slide fasteners which can be manufactured with minimum cost.

Another object of the invention is to provide a woven stringer tape for slide fasteners which can be heat-sealed to a garment of thermoplastic synthetic resin properly and firmly.

According to the present invention, a stringer tape for slide fasteners comprises an elongate fabric woven of warp and weft threads and including a pair of longitudinally extending, spaced first and second marginal portions and an intermediate portion extending between the first and second marginal portions. The warp threads in the intermediate portion include a plurality of thermoplastic filament yarns and are disposed closely to one another at their interlacings with the weft threads. A higher degree of tension has been applied on the weft threads than on the warp threads of the intermediate portion, while the fabric is being woven, so that the topmost and undermost surfaces of the intermediate portion are defined dominantly by the thermoplastic filament yarns.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION OF THE PREFERRED EMBODIMENT

Figure 1:
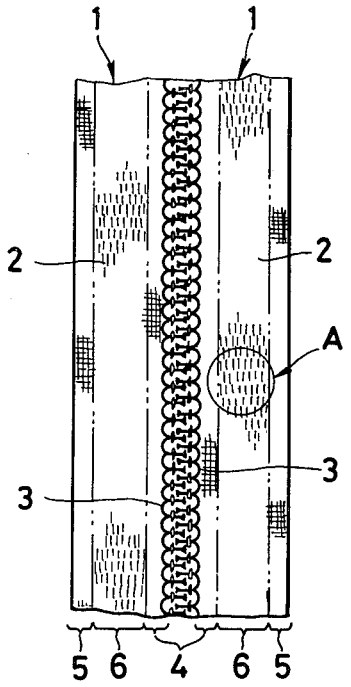
FIG. 1 is a fragmentary plan view of a pair of slide fastener stringers each including a stringer tape according to the present invention.

FIG. 1 shows a pair of slide fastener stringers 1,1 each including a stringer tape 2 and a row of coupling elements 3 mounted on the tape 2 along one longitudinal edge thereof.

The stringer tape 2 comprises a longitudinal woven fabric including a first marginal portion 4 disposed adjacent to the one longitudinal tape edge, a second marginal portion 5 disposed adjacent to the other longitudinal tape edge, and an intermediate portion 6 extending between the first and second marginal portions 4,5.

Figure 2:
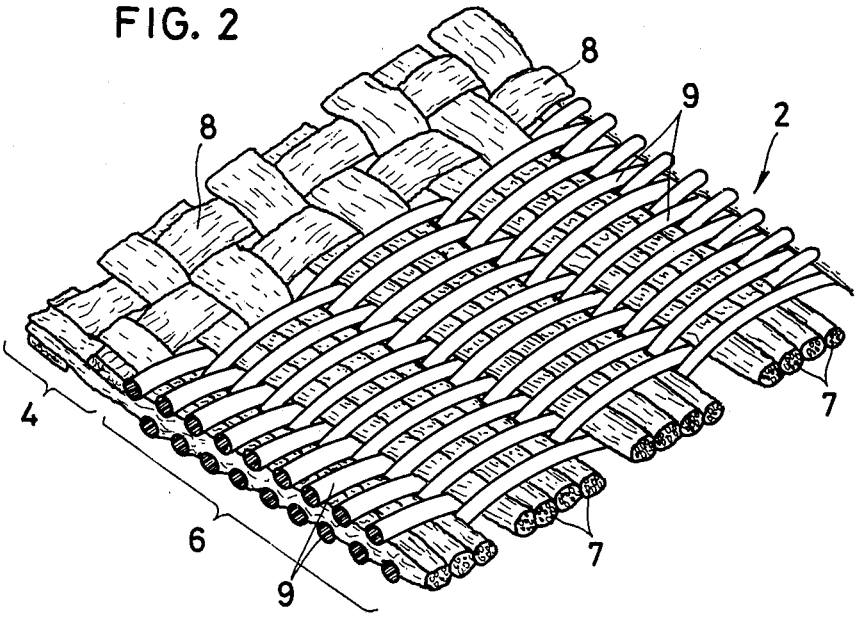
FIG. 2 is a detailed perspective view of a portion A of FIG. 1.

As shown in FIG. 2, the first and second marginal portions 4,5 comprise a plurality of weft threads 7 of bulky textured yarns and a plurality of first warp threads 8 of bulky textured yarns which are interlaced by the weft threads 7 in a pattern of 1/1.

Figure 3:
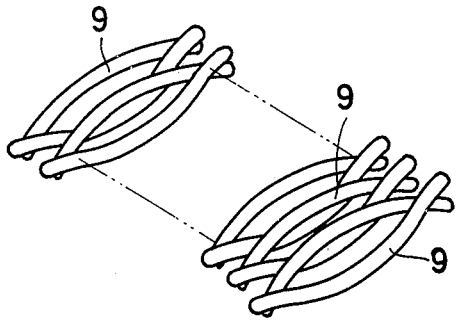
FIG. 3 is a fragmentary perspective view of warp threads in an intermediate tape portion, showing the manner in which the warp threads extends.
Figure 4:
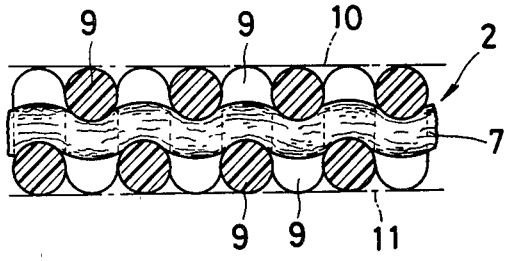
FIG. 4 is a fragmentary, enlarged cross-sectional view of the intermediate tape portion.
Figure 5:
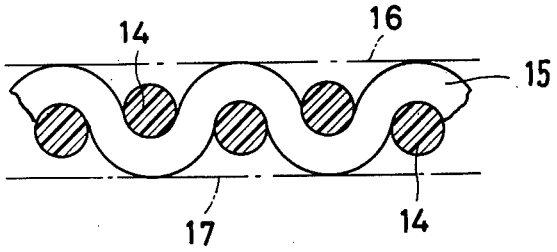
FIG. 5 PRIOR ART
FIG. 5 is a fragmentary, schematic cross-sectional view of a prior art stringer tape.

The intermediate portion 6 comprises a plurality of second warp threads 9 of thermoplastic filament yarns which are interlaced by the weft threads 7 of bulky textured yarns, in a pattern of 2/2, such that the topmost and undermost surfaces 10,11 (FIG. 4) of the intermediate tape portion 6 are defined dominantly by the second warp threads 9 of thermoplastic filaments yarns. The second warp threads 9 are disposed closely to one another at their interlacings with the weft threads 7, as shown in FIGS. 3 and 4.

In this embodiment, 15 to 20 thermoplastic filament yarns of 450 deniers are interlaced, as the second warp threads 9, into the intermediate tape portion 6, which is 6 mm in width here. A number of bulky textured yarns of 300 deniers are used as the weft threads 7. And, a higher degree of tension has been applied on the weft threads 7 than on the second warp threads 9 while the stringer tape 2 is being woven. Preferably, the woven stringer tape 2 is heat-set, in a well known manner, to fix the second warp threads 9 in permanent form such as shown in FIG. 3.

Figure 6:
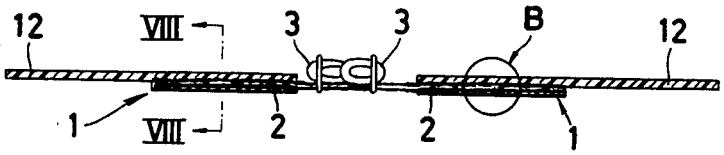
FIG. 6 is a transverse cross-sectional view of a pair of slide fastener stringers each including a stringer tape of the invention, the stringer tapes being heat-sealed to a pair of sheets made of thermoplastic synthetic resin.
Figure 7:
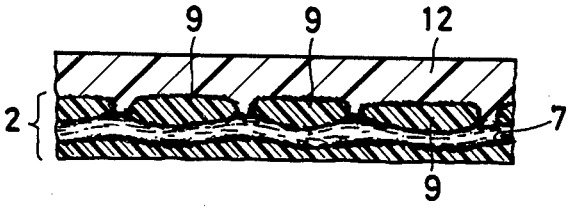
FIG. 7 is a detailed cross-sectional view of a portion B of FIG 6.
Figure 8:
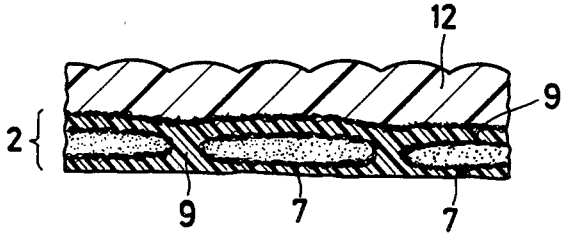
FIG. 8 is an enlarged cross-sectional view taken along line VIII—VIII of FIG. 6.

To attach the fastener stringer 1 to a garment 12 (FIG. 6) of thermoplastic synthetic resin, the stringer tape 2 is superimposed at least at the intermediate portion 6 by the garment 12 and then the bonding areas are fused, for example, by means of a high-frequency generator (not shown). After joining, the weld is cooled, to harden the thermoplastic materials to form the joint. As is apparent from FIGS. 7 and 8 cross-sectionally illustrating the joint on a very large scale, the garment 12 of thermoplastic synthetic resin is fused with the second warp threads 9 of thermoplastic filament yarns which dominantly constitute the topmost surface of the intermediate tape portion 6. The second warp threads 9 are bonded with the weft threads 7; the latter are made of bulky textured yarns and hence permeated with the fused thermoplastic material (of the second warp threads 9). Thus, the stringer tape 2 and the garment 12 are joined together literally integrally with an increased degree of firmness.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A stringer tape for slide fasteners, comprising: an elongate fabric woven of warp threads and sets of weft threads and including a pair of longitudinally extending, spaced first and second marginal portions and an intermediate portion extending between said first and second marginal portions, said warp threads in said intermediate portion including a plurality of thermoplastic filament yarns and being disposed against one another at their interlacings with said sets of weft threads, each said warp thread in said intermediate portion extending meanderlingly in a plane perpendicular to the general plane of said tape alternately over one of said sets of weft threads and under the next of said sets of weft threads, the topmost and undermost surfaces of said intermediate portion being defined dominantly by said thermoplastic filament yarns projecting beyond said weft threads at both said surfaces, said weft threads including a plurality of textured yarns for absorbing melted thermoplastic material, having been tensioned more highly than said warp threads in said intermediate portion while said fabric is being woven, and extending substantially straight.

2. A stringer tape according to claim 1, said warp threads in said first and second marginal portions including a plurality of textured yarns, whereby the thermoplastic material may also be absorbed thereby.

* * * * *